US006072379A

United States Patent [19]

Azzi et al.

[11] Patent Number: 6,072,379

[45] Date of Patent: Jun. 6, 2000

[54] SADDLE SHAPED DEFLECTION WINDING HAVING WINDING SPACES IN THE REAR

[75] Inventors: Nacerdine Azzi, Genlis; Olivier Masson, Cuisery, both of France

[73] Assignee: Thomson Tubes & Displays S.A., Boulogne, France

[21] Appl. No.: 09/319,758

[22] PCT Filed: Dec. 19, 1997

[86] PCT No.: PCT/EP97/07348

§ 371 Date: Jun. 10, 1999

§ 102(e) Date: Jun. 10, 1999

[87] PCT Pub. No.: WO98/28771

PCT Pub. Date: Jul. 2, 1998

[30] Foreign Application Priority Data

Dec. 20, 1996 [FR] France ..... 97 15733

[51] Int. Cl.[7] ..... H01F 7/00

[52] U.S. Cl. ..... 335/210; 335/213; 313/440

[58] Field of Search ..... 335/209–213; 313/440–442

[56] References Cited

U.S. PATENT DOCUMENTS 5,121,028 6/1992 Milini ..... 313/440

5,838,099 11/1998 Hichiwa et al. ..... 335/213

*Primary Examiner*—Lincoln Donovan

*Attorney, Agent, or Firm*—Joseph S. Tripoli; Joseph J. Laks; Sammy S. Henig

[57] ABSTRACT

A deflection yoke for a color cathode ray tube includes a saddle shaped vertical deflection coil and a saddle shaped horizontal deflection coil. The horizontal deflection coil includes winding turns forming a pair of side portions, a front end portion, close to a screen of the tube, and a rear end portion, close to an electron gun of the tube. The side portions form a winding window free of conductor wires therebetween extending between the front end turn portion and the rear end turn portion. Each of the side portions has first, second and third winding spaces. The first, second and third spaces extend into longitudinal coordinates that are closer to an electron gun of the tube than an end portion of the window established by the end turn portion.

3 Claims, 6 Drawing Sheets

SADDLE SHAPED DEFLECTION WINDING HAVING WINDING SPACES IN THE REAR

The invention relates to a deflection yoke for a color cathode ray tube (CRT) of a video display apparatus.

BACKGROUND

A CRT for generating color pictures generally contains an electron gun emitting three coplanar beams of electrons (R, G and B electron beams), to excite on a screen a luminescent material of a given primary color red, green, and blue, respectively. The deflection yoke is mounted the neck of the tube for producing deflection fields created by the horizontal and vertical deflection coils or windings. A ring or core of ferromagnetic material surrounds, in a conventional way, the deflection coils.

The three beams generated are required to converge on the screen for avoiding a beam landing error called convergence error that would otherwise produce an error in the rendering of the colors. In order to provide convergence, it is known to use astigmatic deflection fields called self-converging. In a self-converging deflection coil, the field nonuniformity that is depicted by lines of flux generated by the horizontal deflection coil has generally pincushion shape in a portion of the coil situated in the front part, closer to the screen.

A geometry distortion referred to as pincushion distortion is produced in part because of the non-spherical shape of the screen surface. The distortion of the picture, referred to as North-South at the top and bottom and East-West at the side of the picture, is stronger as the radius of curvature of the screen is greater.

A coma error occurs because the R and B beams, penetrating the deflection zone at a small angle relative to the longitudinal axis of the tube, undergo a supplementary deflection with respect to that of the center G beam. With respect to the horizontal deflection field, coma is generally corrected by producing a barrel shape horizontal deflection field at the beam entrance region or zone of the deflection yoke, behind the aformentioned pincushion field that is used for convergence error correction.

A coma parabola distortion is manifested in a vertical line at the side of the picture by a gradual horizontal direction shift of the green image relative to the mid-point between the red and blue images as the line is followed from the center to the corner of the screen. If the shift is carried out toward the outside or side of the picture, such coma parabola error is conventionally referred to as being positive; if it is carried out toward the inside or center of picture, the coma parabola error is referred to as being negative.

It is common practice to divide the deflection field into three successive action zones along the longitudinal axis of the tube: the back or rear zone closest to the electron gun, the intermediate zone and the front zone, closest to the screen. Coma error is corrected by controlling the field in the rear zone. Geometry error is corrected by controlling the field in the front zone. Convergence error is corrected in the rear and intermediate zones and is least affected in the front zone.

In the prior art deflection yoke of FIG. 2, permanent magnets 240, 241, 242 are positioned in front of the deflection yoke to reduce geometry distortions. Other magnets 142 and field shapers are inserted between the horizontal and vertical deflection coils to modify locally the field to reduce coma, parabola coma, and convergence errors.

When the screen has a relatively large radius of curvature greater than IR, such as 1.5R or more, for example, it becomes more and more difficult to solve the beam landing errors previously described without utilizing magnetic helpers such as shunts or permanent magnets. It may be desirable reduce error such as the coma parabola error, coma error or convergence error by controlling winding distributions of the deflection coils without utilizing magnetic helpers such as shunts or permanent magnets.

Eliminating the shunts or permanent magnets is desirable because, disadvantageously, these additional components may produce a heating problem in the yoke related to higher horizontal frequency, particularly when the horizontal frequency is 32 kHz or 64 kHz and more. These additional components may also, undesirably, increase variations among the produced yokes in a manner to degrade geometry, coma, coma parabola and convergence error corrections.

SUMMARY

A video display deflection apparatus, embodying an inventive feature, includes a deflection yoke. The deflection yoke includes a saddle shaped, first deflection coil for producing a deflection field to scan an electron beam along a first axis of a display screen of a cathode ray tube. The first deflection coil includes winding turns forming a pair of side portions, a front end portion, close to the screen, and a rear end portion, close to an electron gun of the tube. The side portions form a winding window free of conductor wires therebetween having a first end portion established by the rear end turn portion and a second end portion established by the front end turn portion. At least one of the side portions has first, second and third winding spaces extending into longitudinal coordinates that are closer to the electron gun than a longitudinal coordinates of the first end portion. The first winding space has a portion extending into longitudinal coordinates that are included within the window. A second deflection coil is used for scanning the electron beam along a second axis of the screen to form a raster. A magnetically permeable core cooperates with the first and second deflection coils to form the deflection yoke.

Advantageously, the coperation among the three winding spaces reduces horizontal coma error. By extending one of the three winding spaces into longitudinal coordinates that are within the window, the convergence error and coma parabola error are also reduced.

DESCRIPTION OF THE PREFERRED EMBODIMENTS

Figure 1:
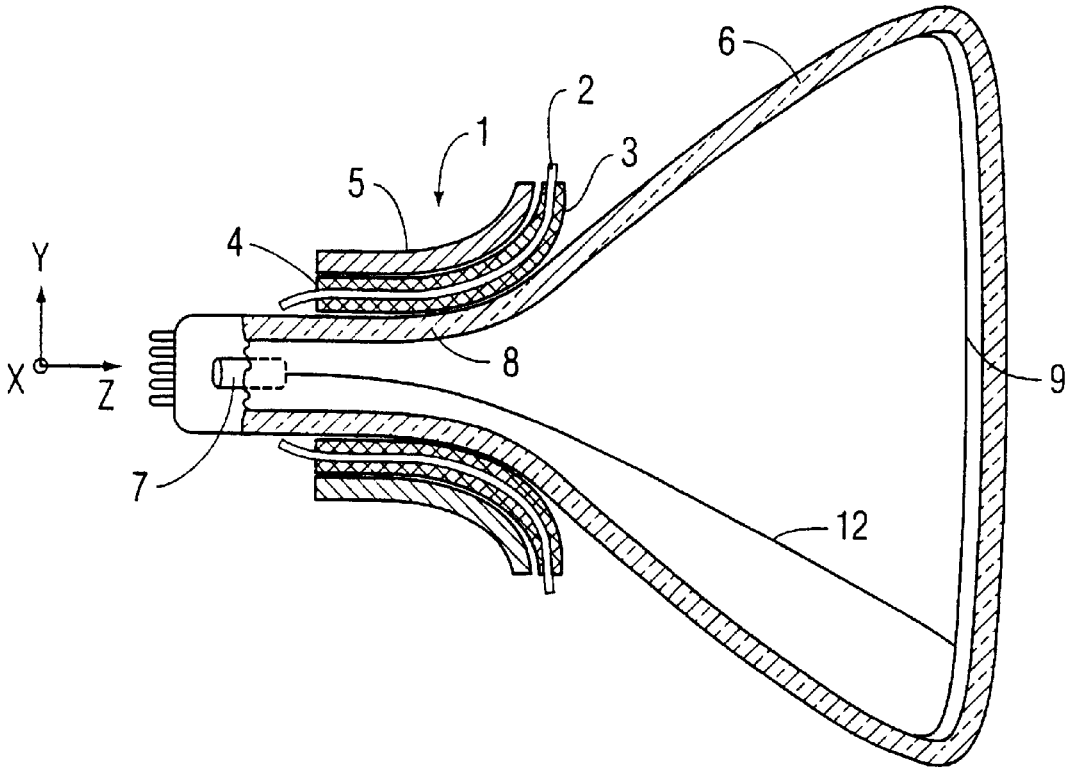
FIG. 1 illustrates a deflection yoke, according to an inventive arrangement, mounted on a cathode ray tube.
Figure 2:
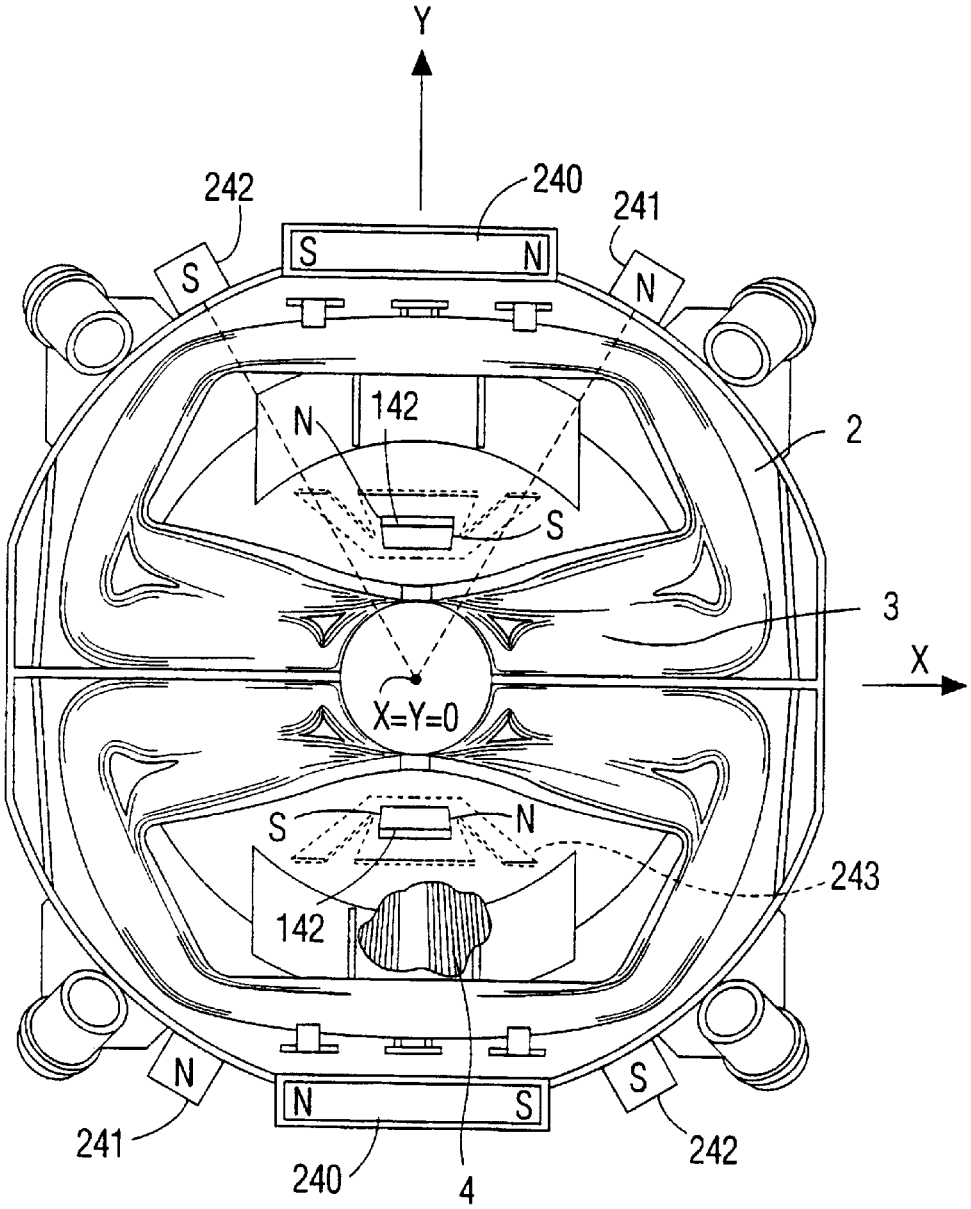
FIG. 2 PRIOR ART
FIG. 2 illustrates a frontal, exploded view of a deflection yoke according to the prior art.

As illustrated in FIG. 1, a self-converging color display device includes a cathode ray tube (CRT) having an evacuated glass envelope 6 and an arrangement of phosphorous or luminescent elements representing the three primary colors R, G and B arranged at one of the extremities of the envelope forming a display screen 9. Electron guns 7 are arranged at a second extremity of the envelope. The set of electron guns 7 is arranged so as to produce three electron beams 12 aligned horizontally in order to excite corresponding luminescent color elements. The electron beams sweep the surface of the screen by the operation of deflection yoke 1 mounted on a neck 8 of the tube. Deflection yoke 1 includes a pair of horizontal deflection coils 3, a pair of vertical deflection coils 4, isolated from each other by a separator 2, and a core of ferromagnetic material 5 provided to enhance the field at the beam paths.

Figure 3A:
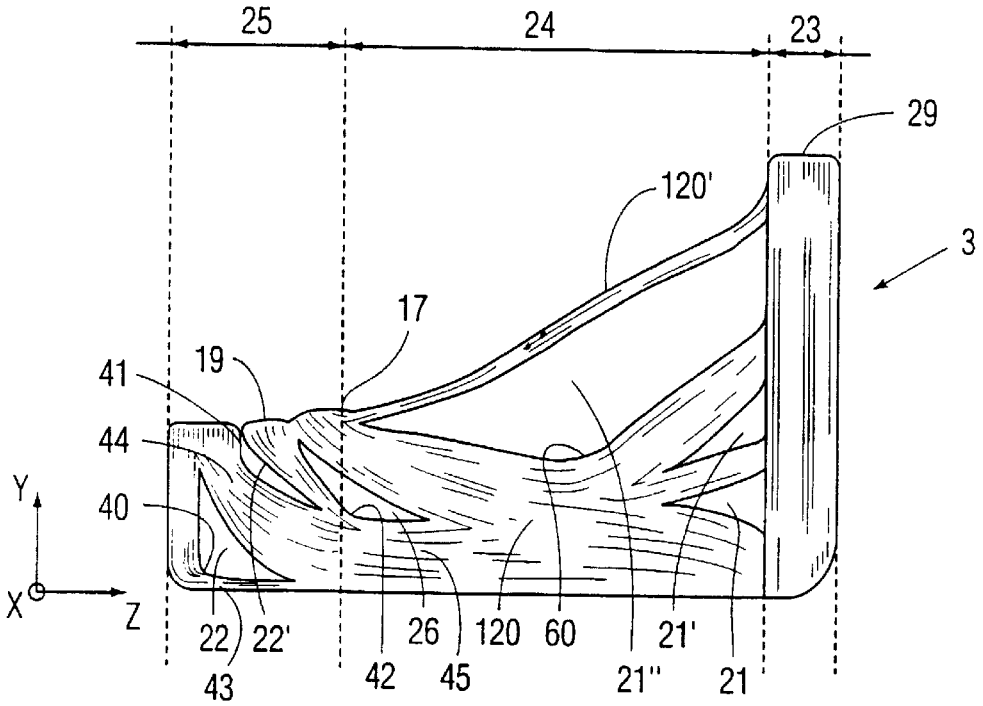
FIGS. 3*a* and 3*b* represent a side view and a top view, respectively, of a horizontal deflection coil according to an inventive arrangement.
Figure 3B:
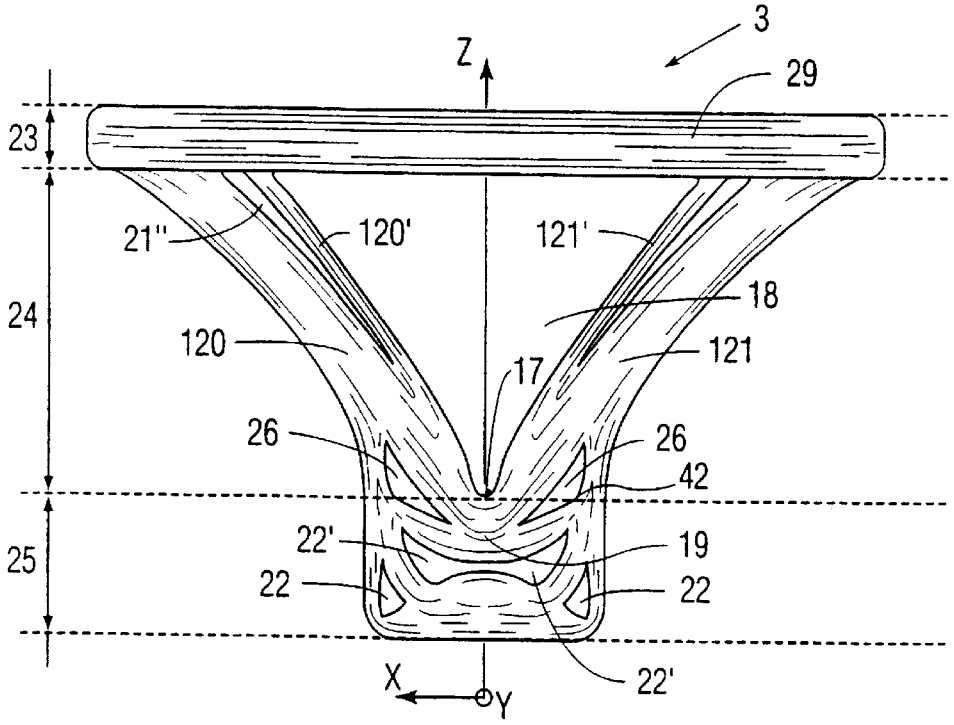

FIGS. 3*a* and 3*b* illustrate, respectively, the side and top views of one of the pair of horizontal coils or windings 3 having a saddle shape in accordance with an aspect of the invention. Each winding turn is formed by a loop of a conductor wire. Each of the pair of horizontal deflection coils 3 has a rear end turn portion 19, near the electron gun 7 of FIG. 1, and extending along the longitudinal or Z axis. A front end turn portion 29 of FIGS. 3*a* and 3*b*, disposed close to display screen 9, is curved away from the Z axis in a direction generally transverse to the Z axis. Each of core 5 and separator 2 may, advantageously, be fabricated in the form of a single piece rather than being assembled from two separate pieces.

The conductor wires of front end turn portion 29 of the saddle coil 3 of FIGS. 3*a* and 3*b* are connected to rear end turn portion 19 by side wire bundles 120, 120', forming together a side winding portion, along the Z axis, on the one side of the X axis and by side wire bundles 121, 121', on the other side of the X axis. The portions of side wire bundles 120, 120' and 121, 121', situated close to a beam exit region 23, form front spaces 21, 21' and 21" of FIG. 3*a*. The front spaces 21, 21' and 21" affect or modify the current distribution harmonics so as to correct, for example, the geometric distortions of the image formed on the screen such as the north-south distortion. Likewise, the portions of side wire bundles 120, 120' and 121, 121' situated in a beam entrance region 25 of deflection coil 3 form back spaces 22 and 22'. Spaces 22 and 22' have winding distributions selected for correcting the horizontal coma errors. End turn portions 19 and 29 as well as side wire bundles 120' and 121' define a main winding window 18.

The region along the longitudinal Z-axis of end turn portion 29 defines beam exit zone or region 23 of coil 3. The region along the longitudinal Z-axis of window 18 defines an intermediate zone or region 24. Window 18 extends, at one extreme, from the Z-axis coordinate of a corner portion 17 in which side wire bundles 120' and 121' are joined. The other extreme is defined by end turn 29. The zone of the coil situated in the rear behind window 18 including rear end turn 19 is referred to as the beam entrance region or zone 25.

The saddle coil of FIGS. 3*a* and 3*b* may be wound with a copper wire of small dimensions covered with an electrical insulation and with a thermosetting glue. The winding is carried out in a winding machine which winds the saddle coil essentially according to its final shape and introduces spaces 21, 21', 21", 22, 22' of FIGS. 3*a* and 3*b* during the winding process. The shapes and placements of these spaces are determined by retractable pins in the winding head which limit the shapes which these spaces may assume.

After the winding, each saddle coil is kept in a mold and a pressure is applied to it in order to obtain the required mechanical dimensions. A current passes through the wire in order to soften the thermosetting glue which is then cooled again in order to glue the wires to each other and to form a saddle coil which is self supporting.

The placement of space 21" formed in the intermediate region 24 is determined, during the winding process, by a pin at a position 60 of FIG. 3*a* located in the center region of intermediate region 24. The result is that a corner portion is formed at position 60 in space 21". The placement of a space 26 formed in the back portion of intermediate region 24 is determined, during the winding process, by a pin at a position 42 located in the back portion of intermediate region 24. The result is that a corner portion is formed at position 42 of space 26. Both spaces 21" and 26 are located in the side portion formed by the bundle of wires 120 and 120'. The pin at position 60 is situated close to the center of the intermediate zone 24 and substantially further from the end coordinates of window 18. The pin at position 42 is situated in a rear portion of the intermediate zone 24, close to corner portion 17. The length of intermediate zone 24 is equal to the difference between the boundary Z axis coordinate of window 18 formed by end turn portion 29 and the Z axis coordinate of corner portion 17 of window 18.

Each pin produces an abrupt change in the winding distribution and forms a corresponding corner shape portion in the winding space, in a well known manner. For example, on the side of position 60 of FIG. 3*a* that is closer to the entrance zone, the closer it is to corner position 60, the greater is the concentration of the wires. On the other hand, on the side of corner position 60 that is closer to the exit zone, the concentration of the wires decreases, as the distance to position 60 increases. Thus, the concentration of the wires is at a local maximum at position 60.

The placement of the corresponding pins associated with spaces 21" and 26 provides separate control parameters or degrees of freedom for correcting convergence and residual coma error while making it possible to minimize to an acceptable value the coma parabola error. Advantageously, the usage of the combination fo winding space 21", formed in bundle 120 in intermediate region 24, and of a winding space formed in region 25, such as space 22 or 22', provides the required variations along the Z axis such that the use of any local field shapers such as shunts or magnets is, advantageously, avoided.

The majority of the geometry errors are corrected by a known arrangement of wires in the exit zone 23. The coma errors are partially corrected by winding spaces formed in the wires in rear end turn portion 19 of beam entrance zone 25.

In the arrangement of FIGS. 3*a* and 3*b*, the errors of convergence and of residual coma are partially corrected by the operation of a portion of the wires in the intermediate zone established by the pin at position 60 and by the operation of a portion of the wires in the the intermediate zone established by the pin at position 42. Each of the corrections contributes partially to the reduction of the convergence and coma errors.

Advantageously, the aforementioned convergence and coma error corrections by the operations of the pins at positions 42 and 60 produce variations in the coma parabola errors in opposite directions to each other. Therefore, advantageously, the coma parabola error can be minimized to an acceptable magnitude.

In the example of FIGS. 3*a* and 3*b*, the deflection yoke is mounted on a tube of the type A68SF having a screen of the aspherical type and a radius of curvature on the order of 3.5R in the horizontal edges. The horizontal coil 3 has a total length along the Z axis that is equal to 81 mm. The horizontal coil has a front or beam exit region or zone 23 formed by end turn wire of 7 mm length along the Z axis.

The horizontal coil has intermediate zone 24 having the length 52 mm in which window 18 of FIG. 3*b* extends. The horizontal coil has back or rear end turn wire 19 which extends to a length along the Z axis of 22 mm. The wires at the back of the coil are wound so that they constitute several bundles or groups locally separated from each other by spaces free of wires.

As can be seen by examining the coil of FIGS. 3*a* and 3*b* along its YZ plane of symmetry, in zone 24, spaces 21" and 26 are created by the insertion of pins at locations 60 and 42 during the winding process, as indicated before. The pin at position 60 maintains the bundle of wires 120 to approximately 94% of the number of wires of the coil. The pin at position 60 is located at a distance of 27 mm from the front of the coil, approximately at the center of the intermediate region 24, in an angular position in the XY plane of 31.5 degrees. The pin at location 42 maintains the bundle of wires 45 of FIG. 3*a* to approximately 49% of the number of wires of the coil. The pin at position 42 is arranged at 56 mm from the front of the coil in an angular position in the XY plane that is equal to 33 degrees. Space 26 extends along the Z axis between 47 mm and 62 mm from the front of the deflection coil.

Back end portion 17 of window 18 defines the furthest coordinate in the Z axis from the front of the coil of window 18. Corner portion 17 is situated along the Z axis at a distance of 59 mm from the front of the coil.

Advantageously, the Z axis coordinate of position 42 is selected within a range between a Z axis coordinate that is the same as that of corner portion 17, located at one end of window 18, and a Z axis coordinate that is closer to the screen, at a distance from corner portion 17 approximately 10% of the length of intermediate zone 24. The length of intermediate zone 24 is equal to the distance between the Z axis coordinate of corner portion 17, at the one end of window 18, and the Z axis coordinate at the other end of window 18 formed by end turn portion 29. Selecting the coordinate of position 42 within the range of 10% of the length of the intermediate zone provides optimal coma parabola error correction. It also enables avoiding the usage of shunts and magnets.

In carrying out an inventive feature, in addition to the aforementioned winding space 26 that extends to zone 25, the pair of winding spaces 22 and 22' are also formed in zone 25. Winding spaces 22 and 22' are formed by the insertion of pins at locations 40 and 41, respectively, in zone 25 of the rear end turn wire, during the winding process.

The pin at location 40 of FIG. 3*a* forms a bundle of wires 43, representing approximately 11% of the number of wires of the coil, and is arranged at 75 mm from the front of the coil, in an angular position in the XY plane corresponding to 16 degrees. The pin at location 41 keeps the bundle 44, representing 27% of the number of wires of the coil, and is arranged at 70 mm from the front of the coil in an angular position in the XY plane equal to 55 degrees. Thus, the corner portion of winding space 22', located between winding spaces 22 and 26, with respect to the Z-axis, is at angular position of 55 degree. Advantageously, the corner portions of winding spaces 22 and 26 are at smaller angular positions of 16 degree and 33 degree, respectively, than the angular position of 55 degree of the pin at location 41. By maintaining such angular position order, the pins make it possible to modify locally the higher order coefficients of the field and in particular to reduce the coma error to a sufficiently low value.

As shown in FIG. 3*b*, winding space 22' extends free of conductor wires between the two sides of the plane of symmetry YZ that includes the longitudinal Z axis. Each of winding spaces 22 or 22' may extend between the two sides of the plane of symmetry YZ, as shown in FIG. 3*b* with respect to the pair winding spaces 22'. Alternatively, each of winding spaces 22 or 22' may be formed as a pair of separate winding spaces in the two sides of the plane of symmetry YZ, as shown in FIG. 3*b* with respect to the pair winding spaces 22.

Figure 4A:
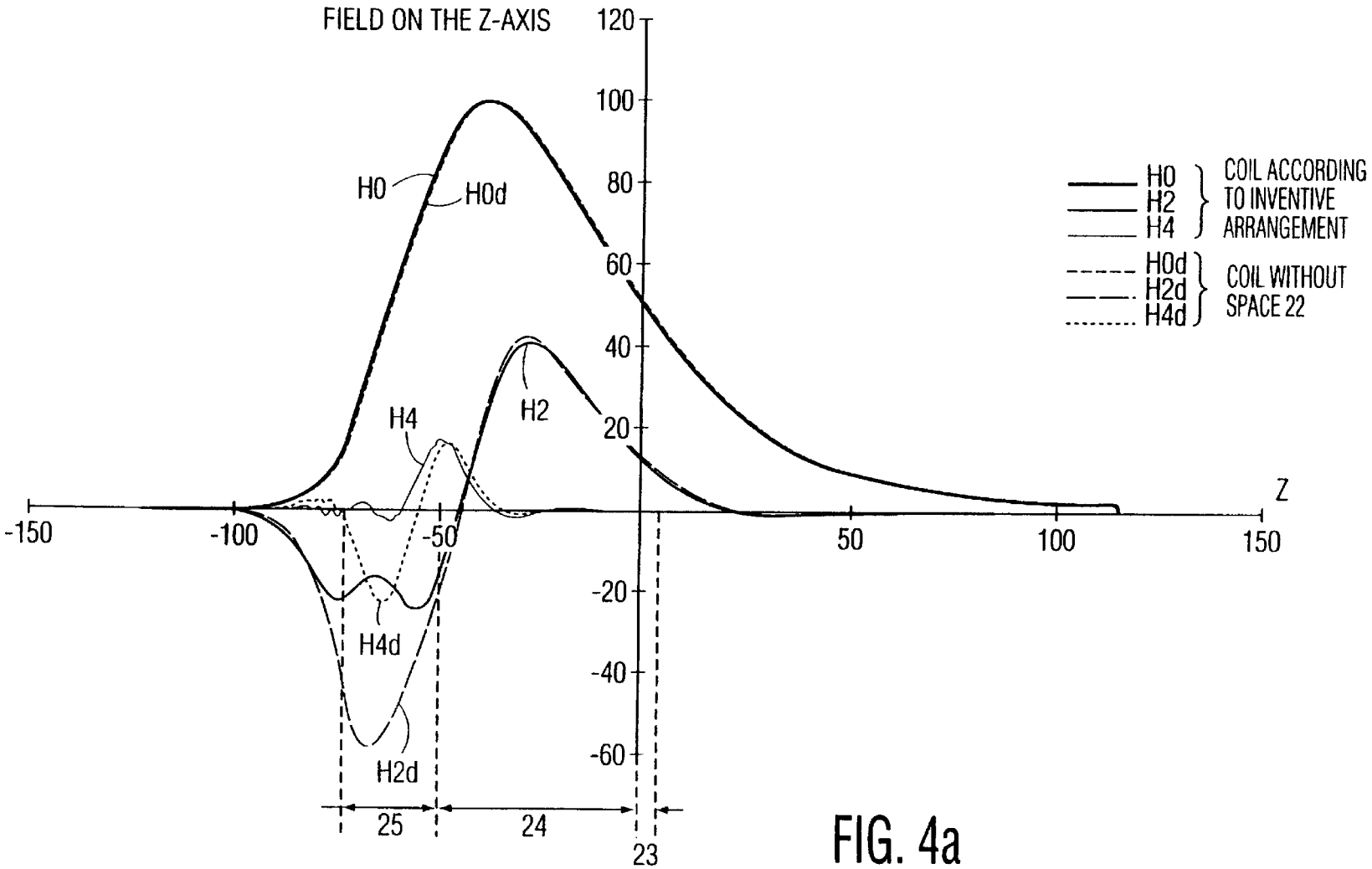
FIGS. 4*a*, 4*b* and 4*c* show the variation, along the main axis Z of the tube, of the horizontal deflection field distribution function coefficients generated by the coil of FIGS. 3*a* and 3*b* and the effects of winding spaces formed in the coil.
Figure 4B:
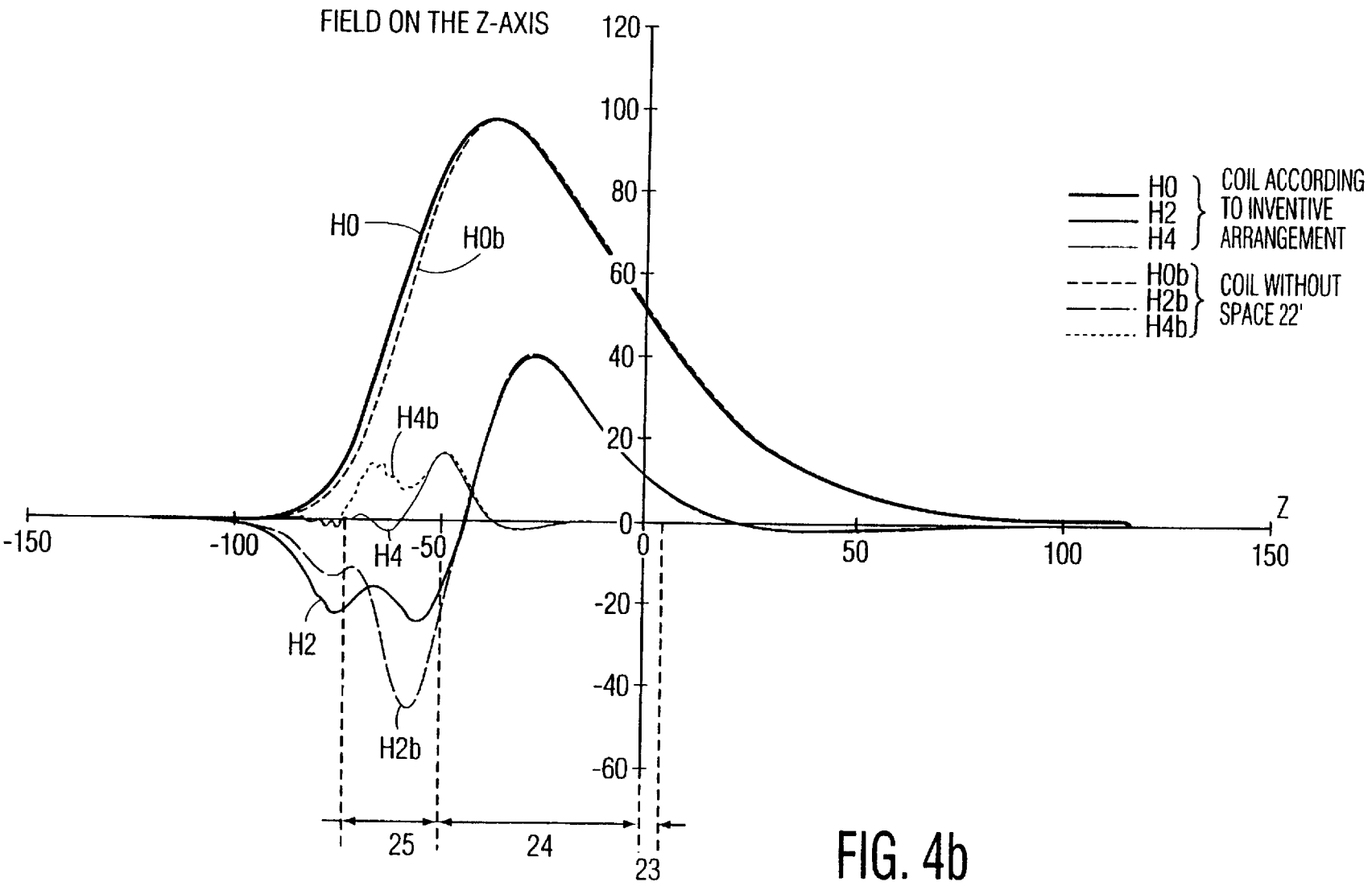

FIGS. 4*a* and 4*b* illustrate the influence of the winding spaces 22 and 22' on the fundamental or zero order coefficient HO and the higher order coefficients H2 and H4 of the field distribution function of the horizontal deflection field. This influence is manifested mainly in the back part of the coil without influencing the zero order and the second order coefficients H0 and H2 of the field distribution function at the front of the deflection yoke.

Figure 4C:
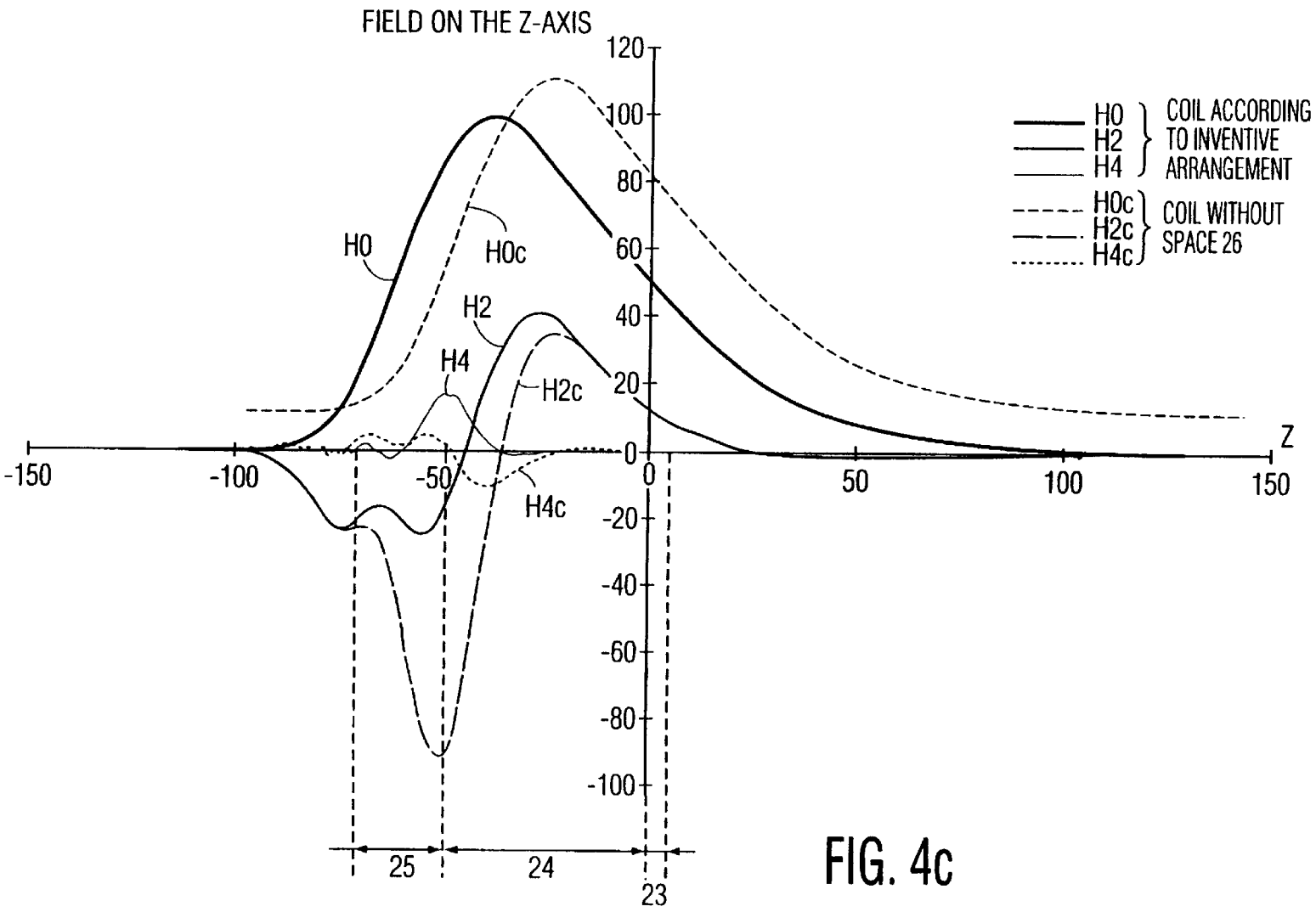

FIG. 4*c* illustrates the influence of space 26 on the zero order coefficient H0 and the higher order coefficients H2 and H4 of the field distribution function of the horizontal deflection field. The influence of space 26 extends both to the front and the back of the coil; it modifies in particular at the front of the intermediate zone, the magnitude and length along the Z-axis on which a positive second order coefficient H2 of the field distribution function of the horizontal deflection field is applied. The second order coefficient H2 of the field distribution function of the horizontal deflection field affects the convergence of the beams and the geometry of the picture.

The following table shows the effects on the errors of geometry, of coma, and of convergence provided by including space 26 in the winding. The results can be compared with those obtained in a deflection yoke that does not include a winding space such as space 26 and in which the coma was corrected by the operation of spaces similar to spaces 22 and 22' and the convergence of the beams by the operation of spaces similar to spaces 21, 21' and 21". In the table, the errors of coma (horizontally and vertically) and of convergence are measured in nine points conventionally representative one quadrant of the screen of the cathode ray tube. The north-south geometry errors are measured relative to the horizontal edges of the picture (external north-south geometry) and at half the distance between one of the edges and the center of the screen (internal north-south geometry).

| | Vertical coma | | | Horizontal coma | | | Convergence | | | N/S geometry |
|---|---|---|---|---|---|---|---|---|---|---|
| Without | 0.06 | −0.07 | −0.1 | 0 | 0.71 | 1.89 | 0.42 | 0.41 | 1.22 | Ext. - 0.11% |
| window | 0.11 | 0.06 | 0.11 | 0 | 0.77 | 2.45 | 0.19 | 0.89 | 4.24 | Int.: - 0.25% |
| 26 | 0 | 0 | 0 | 0 | 0.8 | 2.72 | 0 | 0.97 | 5.74 | |
| With | 0.01 | −0.09 | −0.1 | 0 | 0.03 | 0.11 | 0.4 | 0.19 | 0.49 | Ext. - 0.39% |
| window | 0.1 | 0.06 | −0.1 | 0 | −0 | 0.01 | 0.17 | 0.28 | 0.65 | Int. - 0.54% |
| 26 | 0 | 0 | 0 | 0 | −0 | 0.12 | 0 | 0.14 | 0.93 | |

The table shows that the vertical coma error, already small, is not degraded by the space 26. On the other hand, the horizontal coma error and the convergence error are significantly reduced in particular at the vertical edges of the picture. The north-south geometry of the picture is likewise improved. Advantageously, when space 26 is utilized, pincushion shaped north-south geometry deviation from a straight line, measured on the screen, is closer to the desirable value of −1% than that obtained without using space 26. A deviation of −1% indicates a pincushion shape pattern on the screen. Such deviation is desirable because it is perceived as being free of geometry distortion to a viewer at a distance from the screen equal to five times the height of the picture.

According to the absolute and relative amplitude of the errors to be minimized, the relative percentage of wires which the pin at location 42 keeps below a certain angular position in the XY plane, or the position according to Z of the pin, or the angular position of the same pin can be modified. Space 26 has an appropriate surface area and extends in both the back part 25 and intermediate zone 24 of the coil.

In a mode of implementation not shown, two windows can be formed in the lateral wires situated according to the Z axis in the zone near the end or corner portion 17 of the main window 18. These two windows extend partially both into the zone 24 and into the zone 25. By positioning the pins making these windows during the winding process in different angular positions, it is possible to create groups of wires wherein the number of wires may vary in relative value which permits varying the effect created on the field and obtaining a finer action on the zero order coefficient H0 and the higher order coefficients of the field distribution function of the horizontal deflection field in order to minimize the errors of coma, of geometry, and of convergence.

The previously described implementation examples are not limiting, the insertion during the winding of a pin situated behind the intermediate zone of a coil makes it possible to create a space which can extend to both the intermediate zone and the back zone and can therefore be applicable to modify a vertical deflection field in order to minimize the residual errors of convergence, coma, and geometry.

What is claimed is:

1. A video display deflection apparatus, comprising:

a saddle shaped, horizontal deflection coil for producing a deflection field to scan an electron beam along a horizontal axis of a display screen of a cathode ray tube, said horizontal deflection coil including a plurality of winding turns forming a pair of side portions, a front end portion, close to said screen, and a rear end portion, close to an electron gun of said tube, said side portions forming a winding window free of conductor wires between said side portions, said winding window having a first end portion established by said rear end turn portion and a second end portion established by said front end turn portion, at least one of said side portions having first, second and third winding spaces for correcting beam landing error, each of said spaces extending to a first longitudinal coordinate along an axis perpendicular to said horizontal axis and to a vertical axis of said display screen, said first longitudinal coordinate being closer to said electron gun than a longitudinal coordinate of said first end portion;

a vertical deflection coil for scanning said electron beam along said vertical axis of said screen to form a raster; and a magnetically permeable core for cooperating with said horizontal and vertical deflection coils to form a deflection yoke.

2. A video display deflection apparatus according to claim 1, wherein said first winding space extends mainly into longitudinal coordinates that are within said window.

3. A video display deflection apparatus according to claim 1, wherein said first, second and third winding spaces are formed in each one of said side portions, and wherein said second winding spaces, formed in said side portions, respectively, form corresponding portions of a winding space extending between said side portions.

* * * * *